US011138934B2

(12) United States Patent
Hashimoto

(10) Patent No.: US 11,138,934 B2
(45) Date of Patent: Oct. 5, 2021

(54) DISPLAY DEVICE

(71) Applicant: InnoLux Corporation, Miao-Li County (TW)

(72) Inventor: Kazuyuki Hashimoto, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/877,517

(22) Filed: May 19, 2020

(65) Prior Publication Data

US 2021/0035493 A1 Feb. 4, 2021

Related U.S. Application Data

(60) Provisional application No. 62/880,135, filed on Jul. 30, 2019.

(51) Int. Cl.

| | |
|---|---|
| ***G09G 3/325*** | (2016.01) |
| ***G09G 3/3283*** | (2016.01) |
| ***G09G 3/3266*** | (2016.01) |
| ***G09G 3/20*** | (2006.01) |

(52) U.S. Cl.

CPC ..... *G09G 3/325* (2013.01); *G09G 3/2014* (2013.01); *G09G 3/3266* (2013.01); *G09G 3/3283* (2013.01); *G09G 2310/027* (2013.01); *G09G 2320/064* (2013.01)

(58) Field of Classification Search

CPC ..... G09G 3/2014; G09G 2320/064; G09G 3/2081; G09G 3/32; G09G 3/3406; G09G 3/2018; G09G 2320/0233; G09G 5/02; G09G 3/3233; H04N 9/3123; H03K 7/08; H05B 41/36; H05B 45/10; H02M 3/156

See application file for complete search history.

(56) References Cited

U.S. PATENT DOCUMENTS

| | | | | |
|---|---|---|---|---|
| 6,680,721 | B2 * | 1/2004 | Murade | G09G 3/3674 345/100 |
| 10,283,037 | B1 * | 5/2019 | Far | G09G 3/2014 |
| 10,694,597 | B2 * | 6/2020 | Watsuda | H03K 19/20 |
| 10,720,098 | B2 * | 7/2020 | Valentine | G09G 3/3208 |
| 10,748,473 | B2 * | 8/2020 | Yang | H03K 25/02 |
| 10,820,388 | B1 * | 10/2020 | Hashimoto | H05B 45/325 |
| 2001/0019319 | A1 * | 9/2001 | Kim | G09G 3/2081 345/77 |
| 2005/0264223 | A1 * | 12/2005 | Lee | G09G 3/22 315/160 |
| 2006/0156121 | A1 * | 7/2006 | Chung | G09G 3/3233 714/726 |
| 2006/0279492 | A1 * | 12/2006 | Chen | G09G 3/3216 345/77 |

(Continued)

FOREIGN PATENT DOCUMENTS

| | | | |
|---|---|---|---|
| CN | 102867481 | A | 1/2013 |
| CN | 103093721 | A | 5/2013 |
| CN | 105528998 | A | 4/2016 |

*Primary Examiner* — Sanjiv D. Patel

(74) *Attorney, Agent, or Firm* — Winston Hsu

(57) ABSTRACT

A display device includes a pixel. The pixel includes a light emitting unit and a driving circuit for driving the light emitting unit. When the light emitting unit is driven in a pulse width modulation (PWM) mode with a PWM period, the PWM period includes a plurality of pulse controllable periods.

16 Claims, 5 Drawing Sheets

(56) References Cited

U.S. PATENT DOCUMENTS

| | | | | |
|---|---|---|---|---|
| 2009/0085845 | A1* | 4/2009 | Cho | G09G 3/2014 345/83 |
| 2009/0108768 | A1* | 4/2009 | Yang | H05B 45/325 315/291 |
| 2012/0327128 | A1* | 12/2012 | Li | G09G 3/32 345/690 |
| 2015/0339998 | A1* | 11/2015 | Yen | G09G 3/32 345/100 |
| 2016/0093251 | A1* | 3/2016 | Chung | G01J 1/0403 345/207 |
| 2016/0232848 | A1* | 8/2016 | Meng | G09G 3/3258 |
| 2018/0075801 | A1* | 3/2018 | Le | G09G 3/3233 |
| 2018/0090048 | A1* | 3/2018 | Tang | G09G 3/2018 |
| 2018/0180941 | A1* | 6/2018 | Zhang | G02F 1/133602 |
| 2018/0182279 | A1* | 6/2018 | Sakariya | G09G 3/2081 |
| 2018/0211582 | A1* | 7/2018 | Sakariya | G09G 3/32 |
| 2018/0293929 | A1* | 10/2018 | Shigeta | G09G 3/2011 |
| 2018/0301080 | A1* | 10/2018 | Shigeta | G09G 3/3208 |
| 2019/0147793 | A1* | 5/2019 | Valentine | G09G 3/3208 345/691 |
| 2019/0347980 | A1* | 11/2019 | Kuo | G09G 3/32 |
| 2020/0111418 | A1* | 4/2020 | Nam | G09G 3/3233 |
| 2020/0135092 | A1* | 4/2020 | Ahmed | G09G 3/32 |
| 2020/0365074 | A1* | 11/2020 | Hashimoto | G09G 3/3233 |

* cited by examiner

DISPLAY DEVICE

CROSS REFERENCE TO RELATED APPLICATION

This non-provisional application claims priority of US provisional application No. 62/880,135, filed on Jul. 30, 2019, included herein by reference in its entirety.

BACKGROUND OF THE DISCLOSURE

1. Field of the Disclosure

The present disclosure is related to a display device, and more particular to a display device having a pulse width modulation (PWM) mode.

2. Description of the Prior Art

In general, the light emitting components are usually driven to present different gray levels with currents of different intensities. For example, if the light emitting component is driven by a large current, then the light emitting component may emit light with higher brightness. Contrarily, if the light emitting component is driven by a small current, then the light emitting component may emit light with lower brightness. However, when the light-emitting component is driven by a small current, the light emitted from the light-emitting component easily undergoes a significant color shift, resulting in poor picture quality.

SUMMARY OF THE DISCLOSURE

One embodiment of the present disclosure discloses a display device. The display device includes a pixel.

The pixel includes a light emitting unit and a driving circuit for driving the light emitting unit. When the light emitting unit is driven in a pulse width modulation (PWM) mode with a PWM period, the PWM period comprises a plurality of pulse controllable periods.

These and other objectives of the present disclosure will no doubt become obvious to those of ordinary skill in the art after reading the following detailed description of the embodiment that is illustrated in the various figures and drawings.

DETAILED DESCRIPTION

Figure 1:
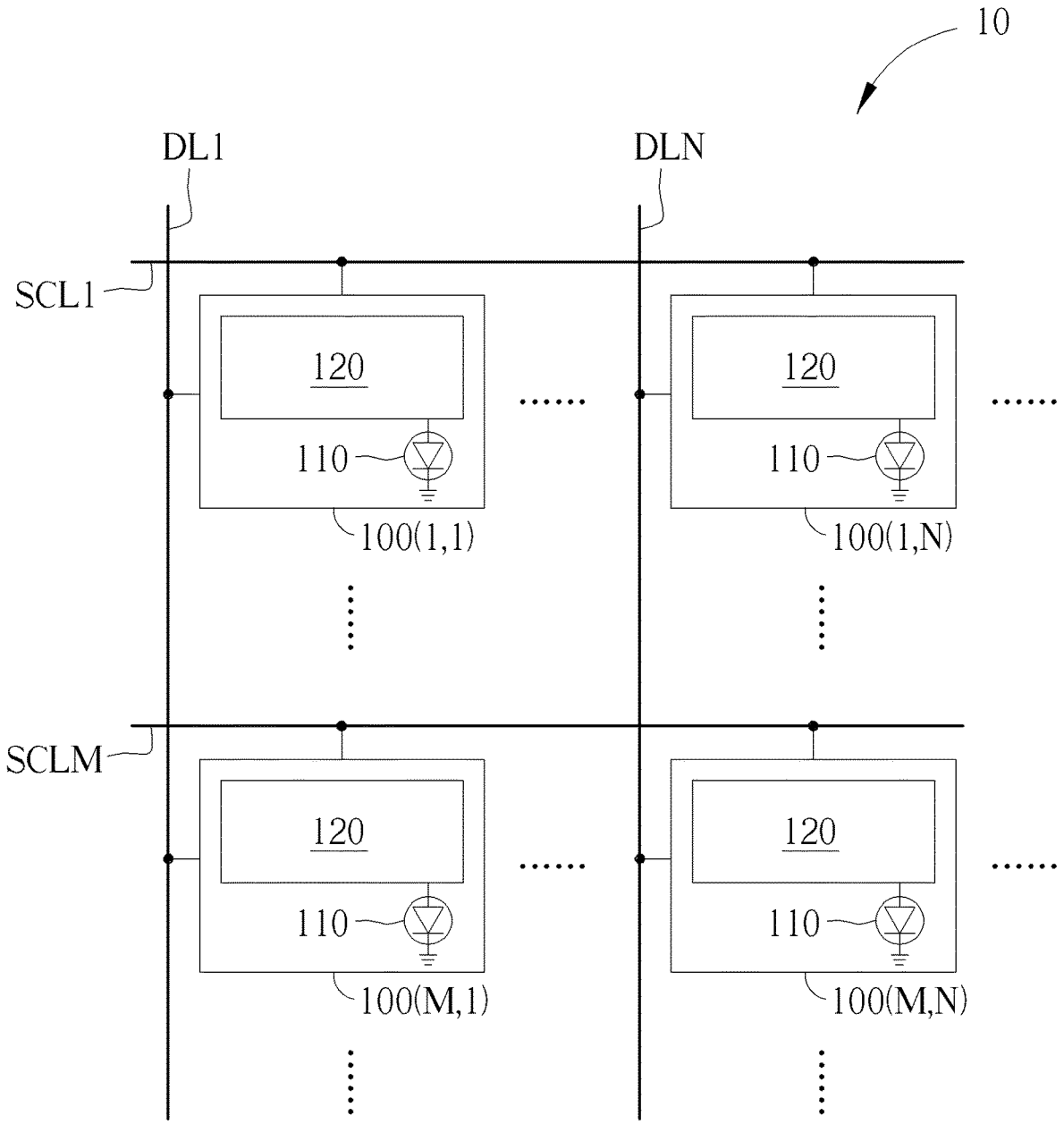
FIG. 1 shows a display device according to one embodiment of the present disclosure.

The term "substantially" as used herein are inclusive of the stated value and means within an acceptable range of deviation for the particular value as determined by one of ordinary skill in the art, considering the measurement in question and the error associated with measurement of the particular quantity (i.e., the limitations of the measurement system). For example, "substantially" can mean within one or more standard deviations, or within ±20%, ±15%, ±10%, ±5%, ±3% of the stated value. It is noted that the term "same" may also refer to "about" because of the process deviation or the process fluctuation.

It should be understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 shows a display device 10 according to one embodiment of the present disclosure. The display device 10 includes a plurality of pixels 100 (1,1) to 100 (M,N), where M and N are positive integers. At least a portion of the pixels 100 100 (1,1) to 100 (M,N) can be used to emit light for presenting different gray levels.

In one embodiment, the display device 10 may be a backlight device emitting light passing through a display panel, but not limited thereto. The pixels may be backlight units of the backlight device, but not limited thereto. In some embodiments, the display device 10 may include a display panel including the pixels 100 (1,1) to 100 (M,N), but not limited thereto. In FIG. 1, pixels disposed in the same row can be coupled to the same scan line, and pixels disposed in the same column can be coupled to the same data line. For example, the pixels 100 (1,1) to 100 (1,N) can be coupled to the scan line SCL1, and the pixels 100 (M,1) to 100 (M,N) can be coupled to the scan line SCLM. Also, the pixels 100 (1,1) to 100 (M, 1) can be coupled to the data line DL1, and the pixels 100 (1,N) to 100 (M,N) can be coupled to the data line DLN.

In some embodiments, each of at least a portion of the pixels 100 (M,1) to 100 (M,N) can include a light emitting unit 110 and a driving circuit 120. The light emitting unit 110 can include a light emitting diode (LED), for example but not limited to an inorganic LED, an organic LED (OLED), a micro-LED, a mini-LED, any other type of light emitting component controlled by current, or a combination thereof. The driving circuit 120 can be used to generate a driving current for driving the light emitting unit 110 according to the gray level to be presented by the pixel.

Furthermore, in order to drive the light emitting unit 110 with better efficiency while reducing the color shift caused by small driving current, the driving circuit 120 can drive the light emitting unit 110 with different modes according to the gray level to be presented.

Figure 2:
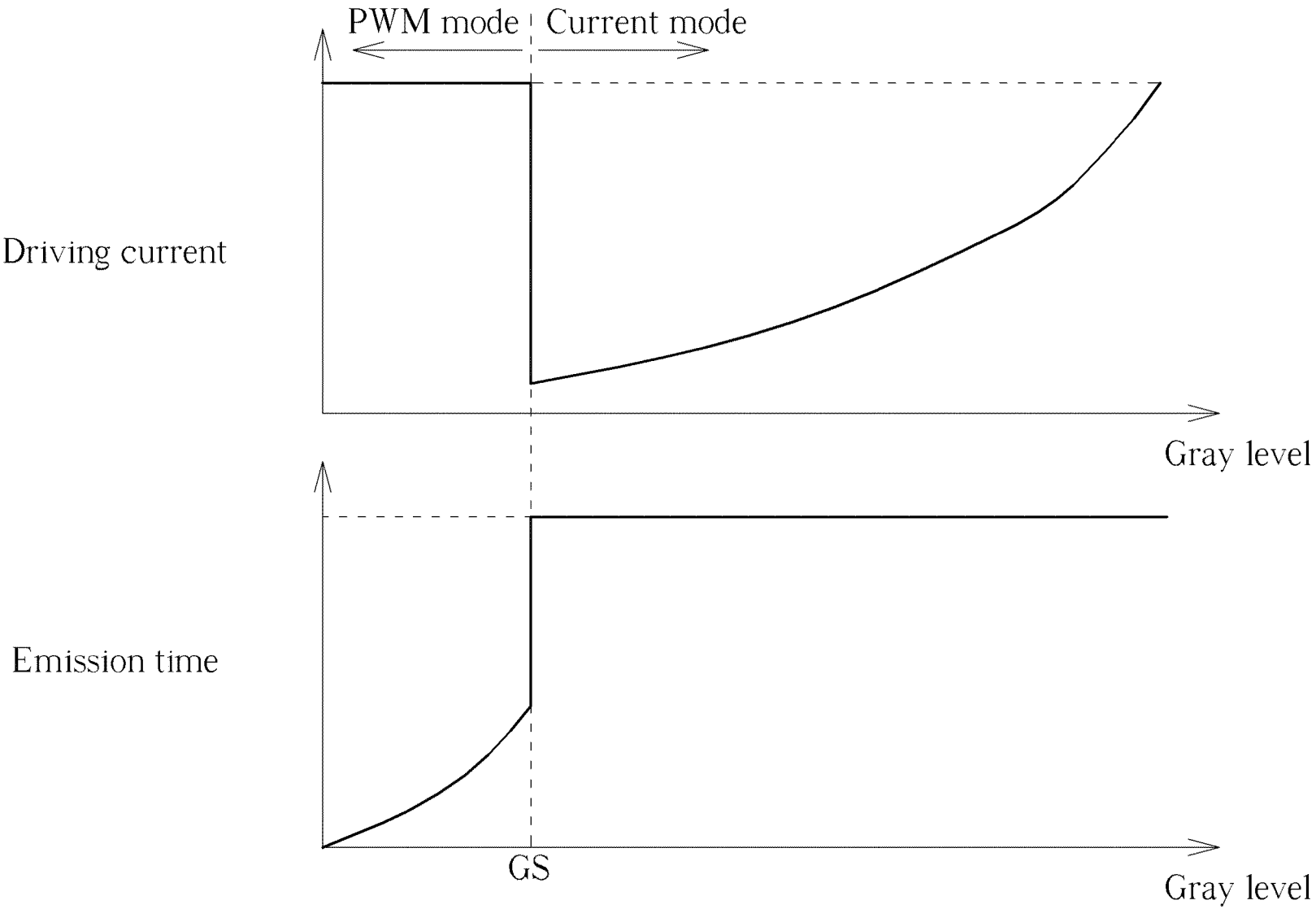
FIG. 2 shows the driving current and the emission times used for driving the pixel in FIG. 1 for different gray levels.

FIG. 2 shows the driving current and the emission time used for driving the pixel 100 (1,1) for different gray levels. In FIG. 2, if the pixel 100 (1,1) is requested to operate in a gray level higher than a predetermined gray level GS, the light emitting unit 110 of the pixel 100 (1,1) would be driven in a current mode. In the current mode, the driving current may increase with the brightness of the gray level while the emission time remains the same.

However, if the pixel 100 (1,1) is requested to operate in a gray level lower than or equal to the predetermined gray level GS, the light emitting unit 110 of the pixel 100 (1,1) would be driven in a pulse width modulation (PWM) mode. In this case, the driving circuit 120 can drive the light emitting unit 110 by modulating the length of the total emission time with a substantially constant driving current having proper intensity. Consequently, the issue of color shift caused by small driving currents can be reduced.

Figure 3:
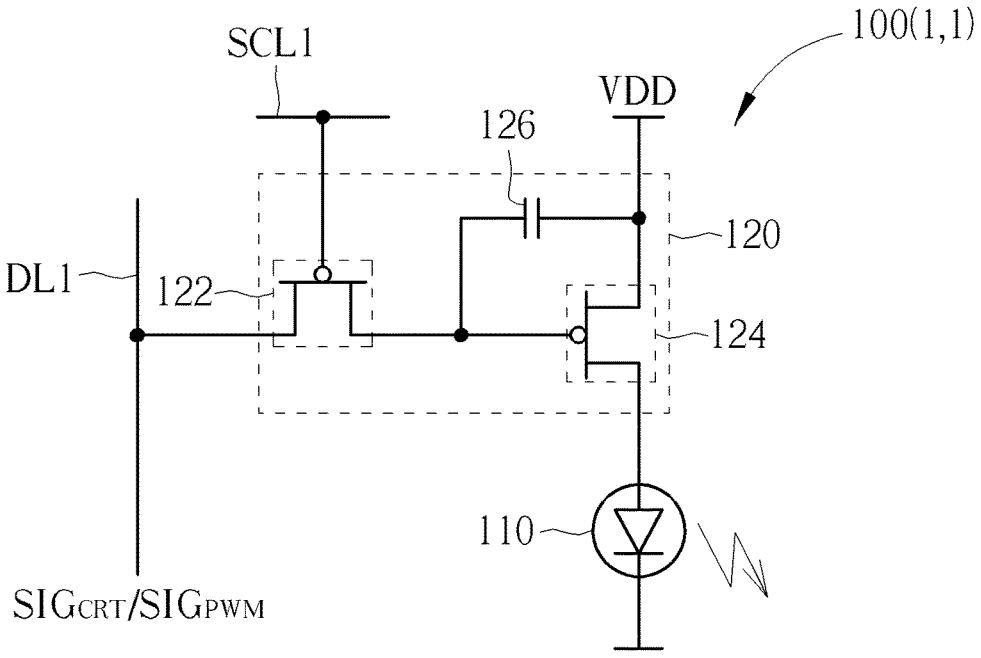
FIG. 3 shows the pixel in FIG. 1 according to one embodiment of the present disclosure.

FIG. 3 shows the pixel 100 (1,1) according to one embodiment of the present disclosure. In FIG. 3, the driving circuit 120 may include a scan transistor 122, a driving transistor 124, and a capacitor 126. It is noted that some of the components of the driving circuit 120 may be omitted for clear illustration, that is, the driving circuit 120 may include more components than the components shown in FIG.3, but not limited thereto.

The scan transistor 122 may include a first terminal coupled to the data line DL1, a second terminal, and a control terminal coupled to the scan line SCL1. The driving transistor 124 may include a first terminal for receiving an operation voltage VDD, a second terminal coupled to the light emitting unit 110, and a control terminal coupled to the second terminal of the scan transistor 122. The capacitor 126 may include a fist terminal coupled to the control terminal of the driving transistor 124, and a second terminal coupled to the first terminal of the driving transistor 124.

When the driving circuit 120 drives the light emitting unit 110 in the current mode, the scan transistor 122 can be turned on, and the control terminal of the driving transistor 124 can receive a current data signal $SIG_{CRT}$ through the data line DL1. In some embodiments, the voltage of the current data signal $SIG_{CRT}$ can be determined by the gray level to be presented by the pixel 100 (1,1), and the current data signal $SIG_{CRT}$, which is recorded by the capacitor 126, can be used to control the intensity of the driving current generated by the driving transistor 124 continuously even when the scan transistor 122 had been turned off.

However, when the driving circuit 120 drives the light emitting unit 110 in the PWM mode, the pixel 100 (1,1) may receive the PWM data signals $SIG_{PWM}$ with a substantially constant voltage during the PWM period.

In some embodiments, the PWM period can include a plurality of pulse controllable periods and at least one hold period. In the pulse controllable period, the light emitting unit 110 can be driven by a driving current with a pulse length determined according to the PWM data signals $SIG_{PWM}$. However, in the hold period, the light emitting unit 110 may remain substantially the same state as it was in the end of the previous pulse controllable period. That is, the light emitting unit 110 is turned on or turned off in full of the hold period.

Figure 4:
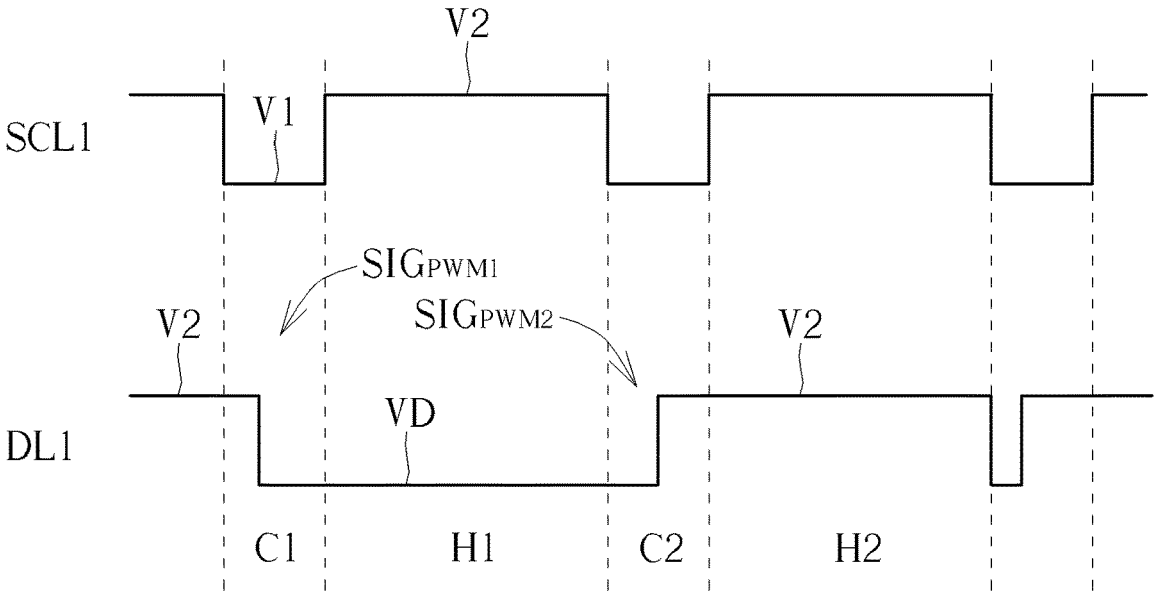
FIG. 4 shows the signal waveforms received by the pixel in FIG. 1 in the PWM mode.

FIG. 4 shows the signal waveforms received by the pixel 100 (1,1) during the pulse controllable periods C1 and C2 and the hold periods H1 and H2 in the PWM mode. In FIG. 4, during the pulse controllable period C1, the data line DL1 can receive a PWM data signal $SIG_{PM1}$ and the scan line SCL1 can be at a first voltage V1 for turning on the scan transistor 122. Therefore, the driving transistor 124 will be turned on according to the PWM data signal $SIG_{PWM1}$.

In the present embodiments, the scan transistor 122 and the driving transistor 124 can include P-type thin film transistors. In this case, a voltage V2 can be a high voltage, for example but not limited to the operation voltage VDD, and the voltage V1 can be a low voltage, for example but not limited to the ground voltage.

Consequently, as the PWM data signal $SIG_{PWM1}$ changes from the voltage V2 to a data voltage VD, which is lower than the voltage V2, during the pulse controllable period C1, the driving transistor 124 may be changed from being turned off to being turned on during the pulse controllable period C1. In this case, if the PWM data signal $SIG_{PWM1}$ changes to the data voltage VD sooner, the driving transistor 124 may be turned on sooner, thereby increasing the emission time of the light emitting unit 110.

Also, during the hold period H1, the scan line SCL1 can be at a second voltage V2 for turning off the scan transistor 122. However, since the voltage of the PWM data signal $SIG_{PWM1}$ can be recorded by the capacitor 126, the driving transistor 124 can remain turned on even when the scan line SCL1 becomes the second voltage V2 during the hold period H1.

In some embodiments, the data voltage VD used for the PWM can be a substantially constant voltage that can turn on the driving transistor 124 properly and cause a stable driving current for the light emitting unit 110 to reduce color shift. However, in some embodiments, the light emitting unit 110 may also be driven with a variable current to present different gray levels in the PWM mode. For example, due to the parasitic capacitance and resistance of the data line DL1, the waveform of the PWM data signal $SIG_{PWM1}$ may be distorted, and the gray levels may not be presented accurately when the turn-on pulse is not long enough. In this case, the data voltage VD can increase linearly or increase step by step as the gray levels, and the driving current can be smaller for the lower gray level to extend the turn-on pulse of the PWM data signals $SIG_{PWM}$.

Furthermore, during the pulse controllable period C2, the data line DL1 can receive a PWM data signal $SIG_{PWM2}$ and the scan line SCL1 can be at the first voltage V1 for turning on the scan transistor 122. Therefore, as the PWM data signal $SIG_{PWM2}$ changes from the data voltage VD to the voltage V2 during the pulse controllable period C2, the driving transistor 124 may be changed from being turned on to being turned off during the pulse controllable period C2. Also, during the hold period H2, the scan line SCL1 can be at the second voltage V2 for turning off the scan transistor 122, and the driving transistor 124 will remain turned off.

That is, the PWM data signals $SIG_{PWM1}$ and $SIG_{PWM2}$ can be used to not only control the turn-on time of the driving transistor 124 in the pulse controllable periods C1 and C2, but also determine whether the driving transistor 124 is turned on or not in the hold periods H1 and H2.

Furthermore, since the scan transistor 122 is turned on in the pulse controllable periods C1 and C2 and is turned off in the hold periods H1 and H2, PWM periods of pixels in different rows can be partially overlapped, thereby allowing the pixels 100 (1,1) to 100 (M,N) to present more gray levels in the PWM mode while not over increasing the length of a frame period.

Figure 5:
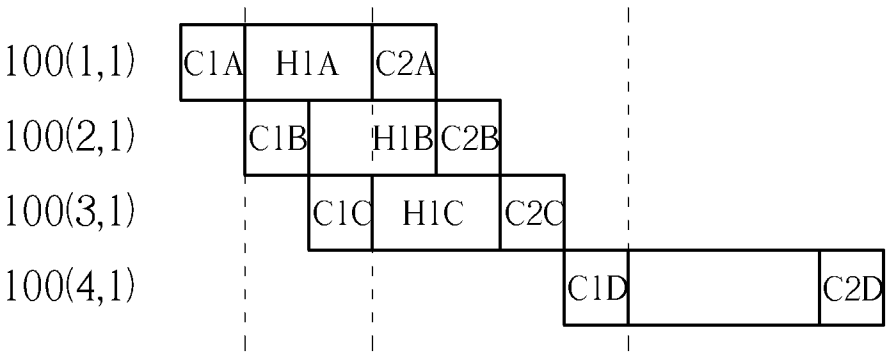
FIG. 5 shows a timing diagram for driving the pixels in FIG. 1 according to one embodiment of the present disclosure.

FIG. 5 shows a timing diagram for driving the pixels 100 (1,1), 100 (2,1), 100 (3,1), and 100 (4,1) according to one embodiment of the present disclosure. For the pixel 100 (1,1), the PWM period includes pulse controllable periods C1A and C2A, and a hold period H1A arranged between the pulse controllable periods C1A and C2A.

In some embodiments, the pulse controllable periods C1A and C2A can be substantially the same, and can be smaller than the hold period H1A. Furthermore, in some embodiments, the total length of the pulse controllable periods C1A and C2A can be substantially equal to the length of the hold period H1A. That is, turning on the light emitting unit 110 in full of the hold period H1A may contribute substantially the same brightness as turning on the light emitting unit 110 in both of the pulse controllable periods C1A and C1B. Therefore, by adjusting the turn-on time during the pulse controllable periods C1A and C2A and determining whether to turn on the light emitting unit 110 during the hold period H1A, the total turn-on time of the PWM period can be controlled accurately and smoothly. Consequently, each of at least portion of the pixels 100 (1,1) to 100 (M,N) is able to present continuous brightness for continuous gray levels.

Furthermore, since the PWM data signals are sent during the pulse controllable periods, the pulse controllable periods of the pixels in different rows should be independent. For example, in FIG. 5, the pulse controllable periods C1A and C2A of the pixel 100 (1,1) do not overlap with the pulse controllable periods C1B and C2B of the pixel (2,1). Similarly, the pulse controllable periods C1B and C2B of the pixel 100 (2,1) do not overlap with the pulse controllable periods C1C and C2C of the pixel (3,1).

Also, since the pixel 100 (1,1) may not receive the PWM data signal during the hold period H1A, the pixels 100 (2,1) and 100 (3,1) can enter the pulse controllable periods C1B and C1C sequentially during the hold period H1A. For example, in FIG. 5, when the pixel 100 (2,1) is in the pulse controllable period C1B, the pixel 100 (1,1) is in the hold period H1A, and when the pixel 100 (3,1) is in the pulse controllable period C1C, the pixel 100 (1,1) is in the hold period H1A and the pixel 100 (2,1) is in the hold period H1B. Furthermore, the pulse controllable period CID of the pixel 100 (4,1) may start after the pulse controllable period C2C of the pixel 100 (3,1), that is, after the pixels 100 (1,1), 100 (2,1) and 100 (3,1) complete their PWM periods.

Consequently, the display device 10 can extend the PWM period for each of at least portion of the pixels to support more gray levels while not over increasing the length of the overall frame period.

Figure 6:
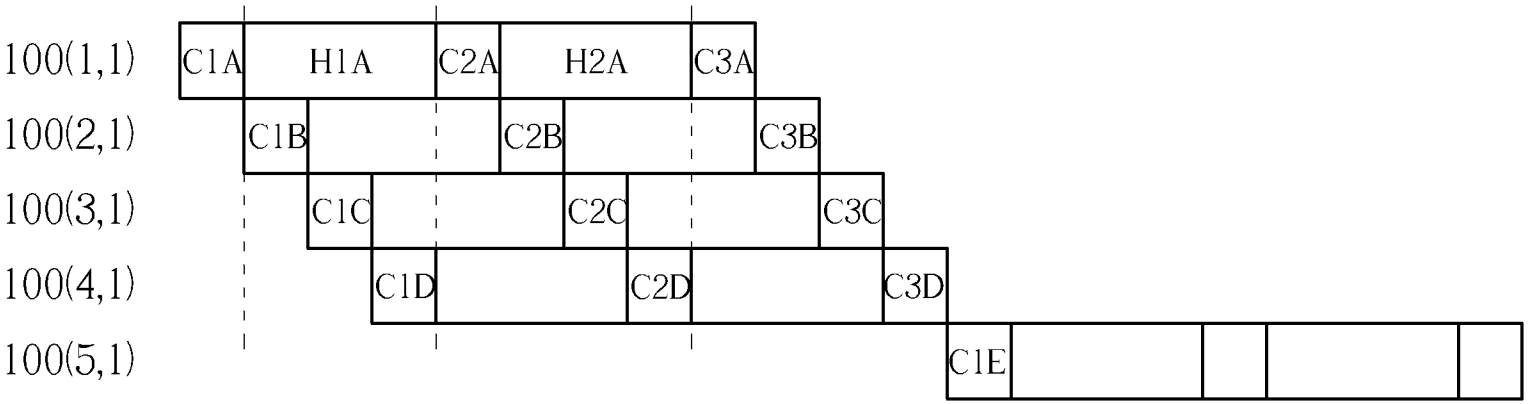
FIG. 6 shows a timing diagram for driving the pixels in FIG. 1 according to another embodiment of the present disclosure.

In some embodiments, the PWM period can be further extended for presenting more gray levels in the PWM modes. FIG. 6 shows a timing diagram for driving the pixels 100 (1,1), 100 (2,1), 100 (3,1), 100 (4,1), and 100 (5,1) according to another embodiment of the present disclosure. For the pixel 100 (1,1), the PWM period includes the pulse controllable periods C1A, C2A and C3A, and the hold periods H1A and H2A. The hold period H1A is arranged between the pulse controllable periods C1A and C2A while the hold period H2A is arranged between the pulse controllable periods C2A and C3A.

In some embodiments, the lengths of the pulse controllable periods C1A, C2A and C3A can be substantially the same, and the sum of the lengths of the pulse controllable periods C1A, C2A and C3A can be substantially equal to the lengths of the hold periods H1A and H2A. In this case, the pixels 100(2,1), 100(3,1), 100(4,1) can enter the pulse controllable periods C1B, C1C, and CID sequentially during the hold period H1A, and enter the pulse controllable periods C2B, C2C, and C2D sequentially during the hold period H2A. Also, the pixels 100(2,1), 100(3,1), 100(4,1) may enter the pulse controllable periods C3B, C3C, and C3D sequentially after the pulse controllable period C3A, and the pulse controllable period CIE of the pixel 100(5,1) may start after the pulse controllable period C3D of the pixel 100(4,1).

In FIG. 6, since the PWM period of each pixel is extended to include more pulse controllable periods and more hold periods than the PWM period shown in FIG. 5, the pixels 100 (1,1) to 100 (M,N) are able to present more gray levels in this case. In some embodiments, the PWM period can include even more pulse controllable periods and hold periods according to similar arrangements shown in FIG. 5 or FIG. 6, and the display device 10 can present even more gray levels according to the system requirement.

Figure 7:
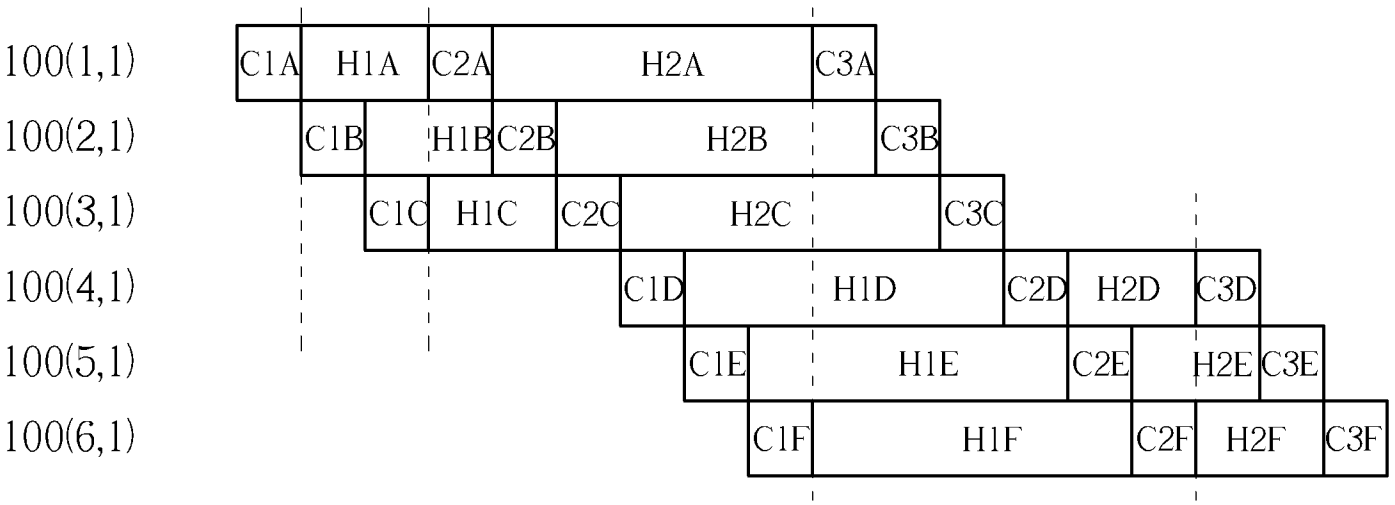
FIG. 7 shows a timing diagram for driving the pixels in FIG. 1 according to another embodiment of the present disclosure.

Also, in FIG. 6, the hold periods H1A and H2A can have substantially the same length. However, in some other embodiments, different hold periods may have different lengths. FIG. 7 shows a timing diagram for driving the pixels 100 (1,1), 100(2,1), 100(3,1), 100(4,1), 100(5,1), 100(6,1) according to another embodiment of the present disclosure. For the pixel 100 (1,1), the PWM period includes pulse controllable periods C1A, C2A and C3A, and hold periods H1A and H2A. The hold period H1A is arranged between the pulse controllable periods C1A and C2A while the hold period H2A is arranged between the pulse controllable periods C2A and C3A.

In FIG. 7, the lengths of the pulse controllable periods C1A, C2A and C3A can be substantially the same; however, the length of the hold period H1A can be different from the length of the hold period H2A. In some embodiments, the total length of the pulse controllable periods C1A, C2A and C3A can be substantially equal to a length difference between the hold periods H1A and H2A. For example, the length of the hold period H1A can be two times the length of the pulse controllable period C1A, and the length of the hold period H2A can be five times the length of the pulse controllable period C1A. In this case, during the hold period H1A, the pixels 100 (2, 1) and 100 (3, 1) can enter the pulse controllable periods C1B and C1C sequentially. Furthermore, during the hold period H2A, the pixels 100 (2, 1), 100(3,1), 100(4,1), 100(5,1), and 100(6,1) can enter the pulse controllable periods C2B, C2C, C1D, C1E, and C1F sequentially.

Also, for the pixel 100(4,1), the hold period H1D can be five times the length of the pulse controllable period C1D, and the length of the hold period H2D can be two times the length of the pulse controllable period C1D. In this case, during the hold period H2D after the pulse controllable period C2D, the pixels 100(5,1) and 100(6,1) can enter the pulse controllable periods C2E and C2F sequentially. Consequently, the display device 10 can extend the PWM period for each of at least portion of the pixels to support more gray levels without over increasing the length of the overall frame period.

In summary, the display devices provided by the embodiments of the present disclosure can drive the pixels in current mode and PWM mode according to the gray levels to be presented. Therefore, the pixels can be driven with better efficiency while decreasing the color shift caused by small driving currents. Furthermore, by including pulse controllable periods and hold periods in a PWM period, PWM periods of pixels in different rows can be partially overlapped. Consequently, each pixel is allowed to present more gray levels in the PWM mode without over increasing the length of a frame period.

Those skilled in the art will readily observe that numerous modifications and alterations of the device and method may be made while retaining the teachings of the disclosure. Moreover, each of the claims constitutes an individual embodiment, and the scope of the disclosure also includes the scope of the various claims and combinations of the embodiments. Accordingly, the above disclosure should be construed as limited only by the metes and bounds of the appended claims.

What is claimed is:

1. A display device, comprising:

a first pixel comprising a light emitting unit and a driving circuit for driving the light emitting unit;

wherein when the light emitting unit is driven in a pulse width modulation (PWM) mode with a PWM period, the PWM period comprises a plurality of pulse controllable periods;

wherein the PWM period further comprises a first hold period arranged between two of the pulse controllable periods, lengths of the plurality of pulse controllable periods are substantially the same, and a length of the first hold period is greater than or equal to a length of one of the pulse controllable periods.

2. The display device of claim 1, wherein when the first pixel operates in a gray level lower than or equal to a predetermined gray level, the light emitting unit is driven in the PWM mode.

3. The display device of claim 2, wherein when the first pixel operates in a gray level higher than the predetermined gray level, the light emitting unit is driven in a current mode.

4. The display device of claim 1, wherein the light emitting unit is turned on or turned off in full of the first hold period.

5. The display device of claim 4, wherein:

the light emitting unit is turned on in the end of a pulse controllable period of the two pulse controllable periods that is right before the first hold period; and the light emitting unit is kept turned on in full of the first hold period.

6. The display device of claim 4, wherein:

the light emitting unit is turned off in the end of a pulse controllable period right before the first hold period; and the light emitting unit is kept turned off in full of the first hold period.

7. The display device of claim 1, wherein a total length of the plurality of pulse controllable periods is substantially equal to a length of the first hold period.

8. The display device of claim 1 further comprising a second pixel, wherein:

the first pixel is disposed in a first row, and the second pixel is disposed in a second row; and pulse controllable periods of the first pixel do not overlap with pulse controllable periods of the second pixel.

9. The display device of claim 8, wherein when the second pixel is in a pulse controllable period, the first pixel is in a hold period.

10. The display device of claim 1, wherein the light emitting unit is driven with a variable current to present different gray levels in the PWM mode.

11. The display device of claim 1, wherein the driving circuit comprises:

a scan transistor having a first terminal coupled to a data line, a second terminal, and a control terminal coupled to a scan line;

a driving transistor having a first terminal configured to receive an operation voltage, a second terminal coupled to the light emitting unit, and a control terminal coupled to the second terminal of the scan transistor; and a capacitor having a first terminal coupled to the control terminal of the driving transistor, and a second terminal coupled to the first terminal of the driving transistor.

12. The display device of claim 11, wherein:

during a pulse controllable period, the data line receives a PWM data signal and the scan line is at a first voltage for turning on the scan transistor; and during a hold period, the scan line is at a second voltage for turning off the scan transistor.

13. A display device, comprising:

a first pixel comprising a light emitting unit and a driving circuit for driving the light emitting unit;

wherein when the light emitting unit is driven in a pulse width modulation (PWM) mode with a PWM period, the PWM period comprises a plurality of pulse controllable periods, a first hold period arranged between two of the pulse controllable periods, and a second hold period, and one of the two pulse controllable periods is arranged between the first hold period and the second hold period.

14. The display device of claim 13, wherein a length of the first hold period is different from a length of the second hold period.

15. The display device of claim 14, wherein a total length of the plurality of pulse controllable periods is substantially equal to a length difference between the first hold period and the second hold period.

16. The display device of claim 13, wherein the light emitting unit is turned on or turned off in full of the first hold period, and the light emitting unit is turned on or turned off in full of the second hold period.

* * * * *